US007913980B1

(12) United States Patent
Cipriano

(10) Patent No.: US 7,913,980 B1
(45) Date of Patent: Mar. 29, 2011

(54) ADJUSTABLE, COLLAPSIBLE AND PORTABLE GAME HOIST

(76) Inventor: Shawn Michael Cipriano, Denver, NC (US)

( * ) Notice: Subject to any disclaimer, the term of this patent is extended or adjusted under 35 U.S.C. 154(b) by 0 days.

(21) Appl. No.: 12/322,552

(22) Filed: Feb. 4, 2009

(51) Int. Cl.
*B66D 3/08* (2006.01)

(52) U.S. Cl. ..... 254/393; 254/413; 452/185; 452/187; 248/218.4; 248/219.1

(58) Field of Classification Search ..... 254/334, 254/335, 336, 338, 393, 399, 413; 452/187, 452/185, 190, 191; 248/219.4, 218.4, 219.1
See application file for complete search history.

(56) References Cited

U.S. PATENT DOCUMENTS

| | | | | |
|---|---|---|---|---|
| 3,568,797 | A * | 3/1971 | Hardy | 182/142 |
| 5,263,675 | A | 11/1993 | Roberts et al. | |
| 5,435,412 | A * | 7/1995 | Franklin et al. | 182/188 |
| 5,562,534 | A | 10/1996 | McGough | |
| 5,820,455 | A | 10/1998 | Breedlove | |
| 5,975,831 | A | 11/1999 | Martin | |
| 6,045,442 | A | 4/2000 | Bounds | |
| 6,062,974 | A | 5/2000 | Williams | |
| 6,152,675 | A | 11/2000 | Compton | |
| 6,250,483 | B1 | 6/2001 | Frommer | |
| 6,695,688 | B1 | 2/2004 | Owen | |
| 6,705,821 | B2 | 3/2004 | Philipps | |
| 6,739,964 | B2 | 5/2004 | Gearhart | |
| 7,341,507 | B1 * | 3/2008 | Julian, Sr. | 452/192 |
| 7,476,149 | B2 * | 1/2009 | Burrows | 452/187 |
| 2003/0000906 | A1 | 1/2003 | Perkins | |
| 2004/0026675 | A1 | 2/2004 | Green | |
| 2005/0136816 | A1 | 6/2005 | Lake | |
| 2008/0085669 | A1 * | 4/2008 | Burrows | 452/187 |

OTHER PUBLICATIONS

Hang 'em High Hoist, pp. 1 and 2, website at www.roperatchet.com/hanghigh.shtml.

* cited by examiner

*Primary Examiner* — Emmanuel M Marcelo

(57) ABSTRACT

A portable game hoist (10) designed for raising and lowering game feeders and fallen game animals in the field. The invention consist of a compact and collapsible triangular support frame which contains a plurality of pulleys in a block and tackle arrangement. The block and tackle can be actuated by a hoist rope (92) to raise and lower game feeders/game animals providing a 6:1 lift to pull ratio. One pulley in the block and tackle arrangement is limited to rotation in a single direction and is positioned to automatically lock as objects are being hoisted. Locking pulley (50) can be unlocked by activating the locking pulley release (49) via the locking pulley release line (51) to allow pulley rotation in either direction. Therefore, unlocking the locking pulley (50) allows all six pulleys to rotate in either direction permitting the lowering of hoisted objects. The triangular support frame includes means for attachment to a tree or pole including a method for hanging temporarily to aid with final attachment.

15 Claims, 6 Drawing Sheets

ADJUSTABLE, COLLAPSIBLE AND PORTABLE GAME HOIST

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention generally relates to portable tree hoist, specifically hoist capable of raising and lowering game feeders or for dressing game animals.

2. Prior Art

When hunting large game such as deer, It is often times desirable and necessary to dress a fallen animal in the field. There are many advantages to field dressing. For example, by leaving behind the unwanted portions of the animal in the field you considerably reduce the overall weight for transportation of the desirable remains. Furthermore, prompt gutting decreases the temperature around the desirable meat reducing the chance of meat spoilage.

While field dressing of game animals is desirable, it also requires that you have means to elevate the fallen animal so that the exposed meat does not get soiled and contaminated. Often times the fallen animal is deep into wooded areas inaccessible by vehicle means. Therefore, there is a need for a portable, compact, lightweight hoisting device which can easily be attached to a tree and operated by a single individual.

Similarly, game feeders such as ones used to disperse corn to deer are often set up in remote wooded areas. These feeders are most commonly made with a drum which houses corn and includes a motor to dispense the corn at determined time intervals. Therefore, a portable, compact, lightweight hoisting device is desirable for lifting and lowering game feeders in remote settings.

Many hunters use a well known Block and Tackle Pulley Technology which utilizes a series of pulleys to reduce the amount of pull required to lift a desired weight. These systems include a hook at the upper end which are often attached to a tree limb for upper support. Another hook at the lower end can be connected to a gambrel for attachment to a deer carcass or for direct attachment to a game feeder (For more on "Block and Tackle Pulley Systems" see www.howstuffworks.com/pulley.htm). The problem exist with finding a tree limb strong enough to support the required weight and with the safety issues required to attach to such.

One prior art product utilizes a patented locking single pulley (U.S. Pat. No. 5,368,281 and U.S. Pat. No. 5,722,640) at the lower end and a separate free turning pulley at the upper end to create a Block and Tackle arrangement (The patented Rope Ratchet and the Hang-'em High Hoist can be viewed at www.roperatchet.com/index.shtml). The amount of force required to lift the desired weight is cut in half. While beneficial, a 2:1 pulling ratio is not sufficient for lifting large deer or even 35 gallon drum feeders filled with corn. In either case, the weight to be hoisted exceeds 200 pounds. Experimenting, I have found that a 4:1 ratio is needed to pull 200 pounds with any ease. My invention is designed with a 6:1 pulling ratio for these same concerns. Additionally, pulleys can not be added to the Hang-'em High Hoist as designed to increase the lifting ratio. The lower pulley which is the patented Ratchet Rope Pulley on the Hang-'em High Hoist does not have means to attach additional pulleys.

U.S. Pat. No. 5,263,675 to Roberts and Gribling, Jr. (1993) is a portable support assembly consisting of a vertical support, a horizontal support and a diagonal support. The disadvantages of this device is that the supported item has to be lifted onto the support assembly. Lifting fallen game such as white tail deer in this manner is cumbersome and generally requires more than a single individual. Secondly, a considerable amount of assembly is required.

U.S. Pat. No. 5,562,534 to McGough (1996) is a portable game hoist which comprises a vertical backing member, a horizontal support frame and a diagonal brace with a winch support at the lower end. McGough's device is mostly welded and therefore is not collapsible to allow easy transport. Furthermore, McGough's device, as with most other comparable hoisting devices, utilizes a winch and cable for lifting. In all but one of the patents I researched, no specification was made for use of an automatic brake winch. It is a serious safety issue to hoist heavy items with a marine trailer type winch. For the lifting process, a marine trailer winch automatically holds the weight as the item is being raised but this is not true for the lowering process. For the decent, once the stop lever is released from the drum gear, the weight of the item hoisted must be manually held back. If you release the stop lever and let go of the handle, the hoisted item will fall suddenly and the winch handle will spin violently. The use of an automatic brake winch is designed to automatically hold the lifted weight during the assent and the decent. The problem with an automatic brake winch, as with a marine trailer winch, is that the added weight of a winch becomes a concern when a hand held portable hoist is desired. Furthermore, an automatic winch is more expensive than a marine trailer winch; and therefore, it becomes an overall cost concern. In addition, if a winch is connected to a compact hoisting frame and is attached to a tree out of reach, the winch operator must climb the tree in order to actuate the winch. If the hoisting device is designed so that the winch can be actuated at ground level with the support frame above, the portability of the unit is compromised.

U.S. Pat. No. 5,820,455 to Breedlove (1998) is a portable game hoist comprising a vertical member, a horizontal member, and a diagonal member. One disadvantage of this device is that the bottom portion of the hoist is not strapped to the tree. Instead, a sharp bracket attached to the bottom of the hoist engages the tree. If the hoist is bumped or bounces for any reason, the hoist could slide by the supporting post causing hoist failure. Also, some assembly is required at the point of use which may require the need for tools. Furthermore, the rope and pulley system described does not have a locking feature to prevent sudden hoist failure if hands slip from the rope. Also, hoisted items must be tied off to a near by tree or the like in order to hold the lifted weight.

U.S. Pat. No. 6,045,442 to Bounds (2000) is a game hoist comprising two vertical supports, two horizontal supports, and a diagonal support. One disadvantage of Bound's device is that it does not collapse into a compact unit for easy transport. A compact unit is oftentimes needed for field dressing of fallen game in dense locations. Secondly, because the winch is separated from the main frame, more set up time is required. When a hoisting device is primarily used for field dressing of fallen game, it is continuously being set up and taken down. Therefore, it is desirable to have a hoisting apparatus which minimizes the amount of set up and take down time required. Finally, the height of the gambrel in the maximum hoisted position is considerably lower than the uppermost horizontal member.

U.S. Pat. No. 6,062,974 to Williams (2000) is a portable game support consisting of a upper arm and a lower arm. While in use, the upper arm is horizontal and is attached to a vertical columnar structure via a chain. The lower arm is diagonal and has two spikes to engage the tree or pole. The problem with William's game support is that the lower arm is not chained or strapped to the vertical columnar member; therefore, if the device is bumped or bounces for any reason, the lower arm could slide down the vertical columnar member causing the hoisted item to drop violently. Furthermore, the single pulley design shown is not sufficient.

U.S. Pat. No. 6,739,964 to Gearhart (2004) is a V-shaped hoist which has an upper frame designed similar to that of climbing tree stands. A rear retaining bar supports the weight on the rear side of the tree or pole, while a V-shaped blade bites into the hoisting side of the tree/pole. A winch is attached separately to the tree/pole via a winch bracket below the upper frame. The disadvantage of Gearhart's device is that it is not collapsible. While the unit can be partially disassemble into a single package for portability, it is bulky and would be cumbersome to carry by hand as are most tree climbing devices.

U.S. Pat. No. 6,695,688 (2004) by James an Alva Owens is a portable hoist designed to be attached to a tree or pole comprising a vertical member and a pivoting support arm. The pivoting support arm is near horizontal while in use. One disadvantage of this device is that the winch must be operated while attached up on the tree and may require elevation means to the operator of the winch. Also, a winch can easily fail if the winch gear locking lever is accidentally disengaged while under load. If this occurs, the load will drop immediately, possibly causing injury to person(s) tending to the lifted object. Another disadvantage of Owens' device is the lack of a diagonal support member which distributes part of the load back to the vertical columnar structure. Without a diagonal support or other means to distribute load, the removable bolt or ball pin is the main means for support. Over time the pin could shear, causing hoist failure.

U.S. Pat. No. 5,975,831 to Martin (1999) and U.S. Pat. No. 6,138,991 to Myers are examples of hoisting devices which require attachment to a vehicle such as an all terrain vehicle (ATV). This type of device can only be used where ATV use is allowed. ATV use is generally prohibited on state-owned game lands. Also, the use of ATV game hoists are obviously restricted to owners of ATV's.

Other patents and patent applications which may have some pertinence to the present invention may include;

U.S. Pat. No. 6,152,675 to Compton (2000)
U.S. Pat. No. 6,705,821 to Phillips (2004)
U.S. Pat. No. 6,250,483 to Frommer (2001)
Patent Application No. 20040026675 to Green (2004)
Patent Application No. 20050136816 to Lake (2005)
Patent Application 20030000906 to Perkins (2003)

BACKGROUND OF INVENTION

Objects and Advantages

Accordingly, several objects and advantages of my invention are:

(a) to provide a hoist which has a 6:1 rope pulling ratio meaning that for every 6 pounds of weight hoisted, only 1 pound of rope pulling force is required.

(b) to provide a hoist that incorporates a rope locking feature so that when an item is being hoisted, the load will automatically lock into the last position whenever the hoist rope is set loose.

(c) to provide a hoist which has a locking pulley release to enable the release of a load in the locked position so that hoisted objects can be lowered to the ground.

(d) to provide a hoist that allows lateral as well as vertical stability.

(e) to provide a hoist which is collapsible into a compact, lightweight unit for ease of transportation without the need for disassembly.

(f) to provide a hoist which unfolds and is ready to hang with no assembly required.

Other objects and advantages are: to provide a hoist which can be temporarily supported to allow hands free strap attachment of the hoist to a tree or pole; to provide a hoist which will allow adjustment to the angle of the supporting arm relative to the angle of the tree; to provide a hoist that allows any single strap to fail without causing total hoist failure.

Further objects and advantages will become apparent from a consideration of the ensuing description and drawings.

SUMMARY

It is thus an object of the invention to provide a portable game hoist which is collapsible into a compact, lightweight unit for easy transport. It is a further object of the invention to provide a portable hoist which is simpler and safer to hang and operate. Furthermore, it is an object of the invention to provide a portable hoist which can be operated while standing on the ground, clear of the hoisted object.

DRAWINGS

Figures

DRAWINGS

Reference Numerals

Figure 1:
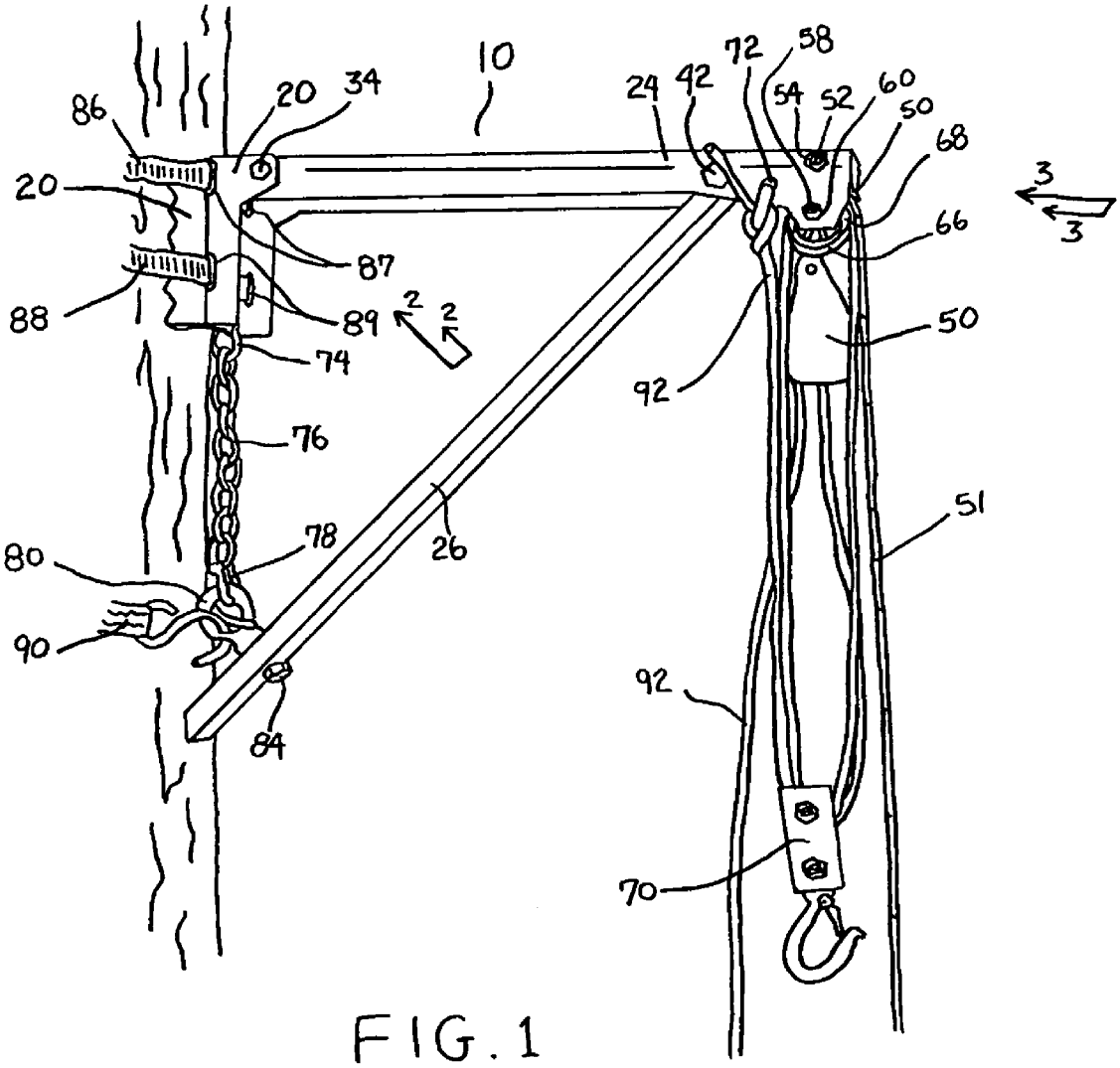
FIG. 1 is a left side perspective view of my invention.

10 portable game hoist
20 vertical support (3" wide×6" long formed 3/16" plate)
24 horizontal support (2 3/8" wide×20 11/16" long formed 3/16" plate)
26 diagonal support (1 1/2"×1" rectangular tubing)
27 hang assist bolt nut
28 hang assist bolt
32 hang assist strap hook
34 inner connect bolt
36 inner connect bolt nut
40 inner connect bolt bushings
42 outer connect bolt
44 outer connect bolt nut
46 outer connect bolt bushings

49 locking pulley release
50 locking pulley
51 locking pulley release line
52 locking pulley support bolt
54 locking pulley support bolt nut
56 locking pulley support bolt bushing
57 locking pulley support bolt washer
58 idler pulley support bolt
60 idler pulley support bolt nut
62 idler pulley support bolt bushing
63 idler pulley support bolt spacer
64 idler pulley support bolt washer
66 inner idler pulley
68 outer idler pulley
70 triple snatch block
72 rope tie hole
74 upper chain shackle
76 vertical chain support
78 lower chain shackle
80 diagonal support eyebolt
84 eyebolt nut
86 upper ratchet strap
87 upper ratchet strap slots
88 lower ratchet strap
89 lower ratchet strap slots
90 hang assist strap
92 hoist rope

DETAILED DESCRIPTION

Preferred Embodiment—FIGS. 1,2,3,4,5

Figure 2:
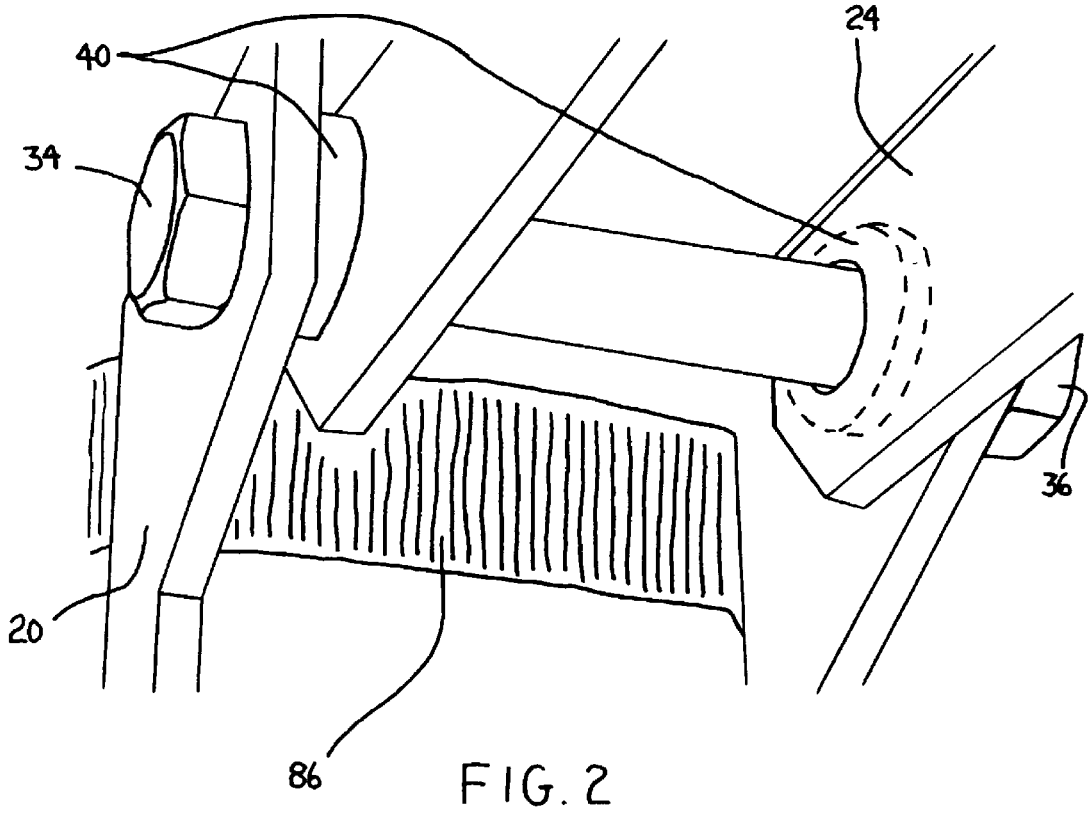
FIG. 2 is a view in detail of the portion indicated by the section lines 2-2 in FIG. 1.

A preferred embodiment of the present invention is illustrated in FIG. 1 which shows a left side perspective view of my portable game hoist 10. The portable game hoist 10 has a vertical support 20 which is pivotally attached to a horizontal support 24 by a inner connect bolt 34. As best seen in FIG. 2, the inner connect bolt 34 is held in place by a inner connect bolt nut 36. Two inner connect bolt bushings 40 separate the vertical support 20 from contact with the horizontal support 24.

Figure 4:
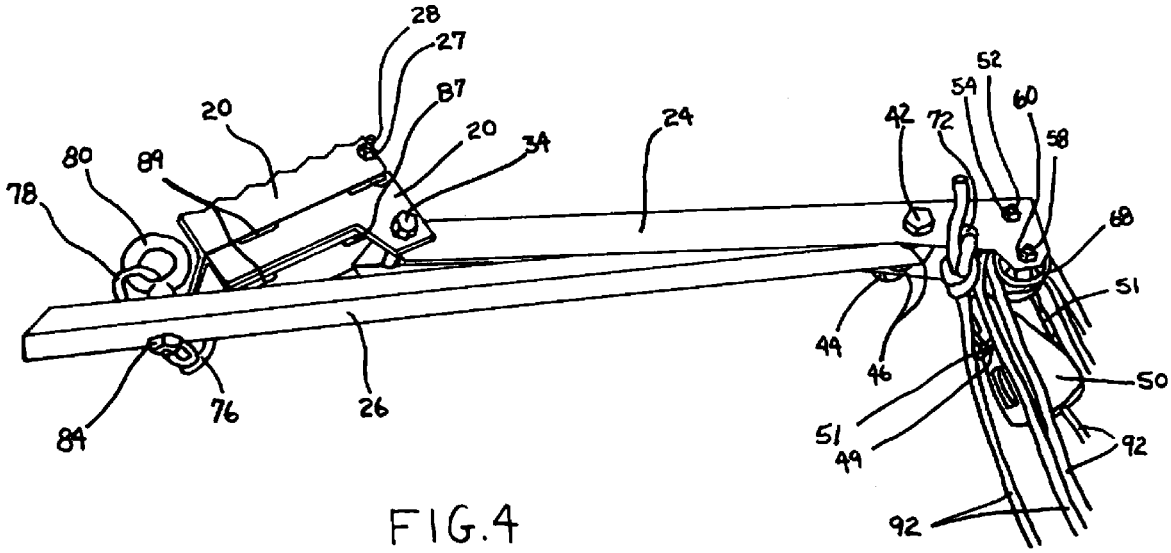
FIG. 4 is a perspective view of my invention held in the collapsed position.
Figure 5:
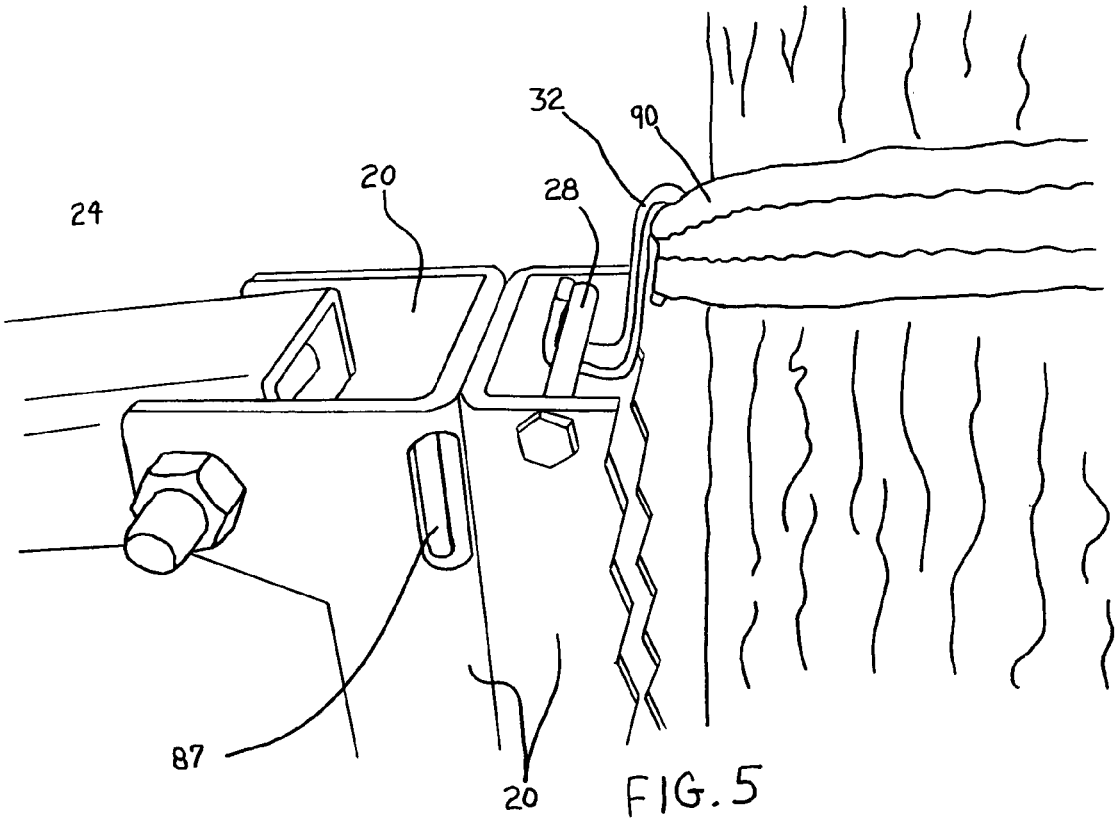
FIG. 5 is a view in detail of my invention hung temporarily to allow hands free strap attachment.

Referring to FIG. 1, a diagonal support 26 is pivotally attached to the horizontal support 24 by an outer connect bolt 42. As seen in FIG. 4, the outer connect bolt 42 is held in place by an outer connect bolt nut 44. Two outer connect bolt bushings 46 separate the horizontal support 24 from contact with the diagonal support 26. Returning to FIG. 1, a diagonal support eyebolt 80 is attached to the lower end of the diagonal support 26 and is held in place by an eyebolt nut 84. A lower chain shackle 78 connects the diagonal support eyebolt 80 to the lower end of a vertical chain support 76. The vertical chain support 76 is attached to the lower end of the vertical support 20 with a upper chain shackle 74. The vertical support 20 is attached to a tree by an upper ratchet strap 86 and a lower ratchet strap 88. The upper ratchet strap 86 and the lower ratchet strap 88 are held within the vertical support 20 by an upper ratchet strap slot 87 and a lower ratchet strap slot 89. The diagonal support eyebolt 80 is secured to the tree by a hang assist strap 90. As seen in FIG. 5, the hang assist strap 90, along with a hang assist strap hook 32, is initially used to temporarily support the portable game hoist 10 for hands free attachment of the upper ratchet strap 86 and the lower ratchet strap 88. Hang assist strap 90 is latter used to secure the lower portion of portable game hoist 10 to a tree or columnar member as shown in FIG. 1. The hang assist strap hook 32 remains with the hang assist strap 90.

As seen in FIG. 1, a hoist rope 92 is attached to the distal end of the horizontal support 24 at a rope tie hole 72. Best seen in FIG. 1 and in FIG. 3, the hoist rope 92 connects a outer idler pulley 68, an inner idler pulley 66 and a locking pulley 50 to a triple snatch block 70. The outer idler pulley 68 and the inner idler pulley 66 are supported by an idler pulley support bolt 58. The idler pulley support bolt 58 is held in place by an idler pulley support bolt nut 60. An idler pulley support bolt bushing 62, an idler pulley support bolt washer 64, and an idler pulley support bolt spacer 63 are all attached to the idler pulley support bolt 58.

A locking pulley support bolt 52 is attached to the distal end of the horizontal support 24 supporting the locking pulley 50. The locking pulley support bolt 52 is held in place by a locking pulley support bolt nut 54. A locking pulley support bolt washer 57 and a locking pulley support bolt bushing 56 are both attached to the locking pulley support bolt 52. A locking pulley release line 51 is attached to the locking pulley 50 and is draped over the locking pulley support bolt 52 at the locking pulley support bolt bushing 56. As seen in FIG. 4, the locking pulley release 49 is an integral part of the locking pulley 50.

OPERATION

Preferred Embodiment—FIGS. 1,3,4,5,6

My invention includes a method for temporarily hanging portable game hoist 10 to allow hands free attachment of upper ratchet strap 86 and lower ratchet strap 88 to a tree or columnar member. Hang assist strap 90, which is a cam style strap, houses hang assist strap hook 32. As seen in FIG. 5, when hang assist strap 90 is attached to a tree or columnar member, the hang assist strap hook 32 can be used for temporary support of portable game hoist 10 at hang assist bolt 28. As seen in FIG. 1, after securing upper ratchet strap 86 and lower ratchet strap 88, hang assist strap 90 is used to secure the lower portion of portable game hoist 10 to a tree or columnar member at diagonal eyebolt 80. The prior art inventions do not offer this feature. Set up operations for the prior art inventions by a single individual would be cumbersome at best.

Continuing in FIG. 1, upper ratchet strap slots 87 and lower ratchet strap slots 89 are laser cut into vertical support 20. Upper ratchet strap 86 is housed inside upper ratchet strap slots 87 allowing attachment of vertical support to a tree or columnar member. Lower ratchet strap 88 is housed inside lower ratchet strap slots 89 allowing additional attachment of vertical support 20 to a tree or columnar member. As best seen in FIG. 5, vertical support 20 is created by welding two pieces of formed sheet metal. Before welding, each piece has a c-shaped profile. The outside c-shaped section has serrated edges designed to engage a tree or wooden pole. The c-shape profile provides lateral support of portable game hoist 10 to a tree or columnar member when upper ratchet strap 86 and lower ratchet strap 88 are tightened around a tree or pole. The outside c-shaped section also houses hang assist bolt 28 which is held in place by hang assist bolt nut 27. Best seen in FIG. 1, matching holes are laser cut into the lower portion of both C-shaped brackets prior to welding to allow attachment of upper chain shackle 74.

As seen in FIG. 4, inner connect bolt 34 provides pivotal attachment of vertical support 20 to horizontal support 24. As seen in FIG. 2, inner connect bolt bushings 40, made of plastic, allow vertical support 20 to pivot with horizontal support 24 without metal to metal contact. As seen in FIG. 4, outer connect bolt 42 provides pivotal attachment of horizontal support 24 to diagonal support 26. Furthermore, outer connect bolt bushings 46, also made of plastic, allow horizontal support 24 to pivot with diagonal support 26 without metal to metal contact. FIG. 4 shows portable game hoist 10 in a fully collapsed position. Portable game hoist 10 can be held in the collapsed position by utilizing upper ratchet strap 86, lower ratchet strap 88 and hang assist strap 90 tightened around horizontal support 24 and diagonal support 26. The ability of portable game hoist 10 to collapse into a compact unit is beneficial for storage and transportation.

Figure 3:
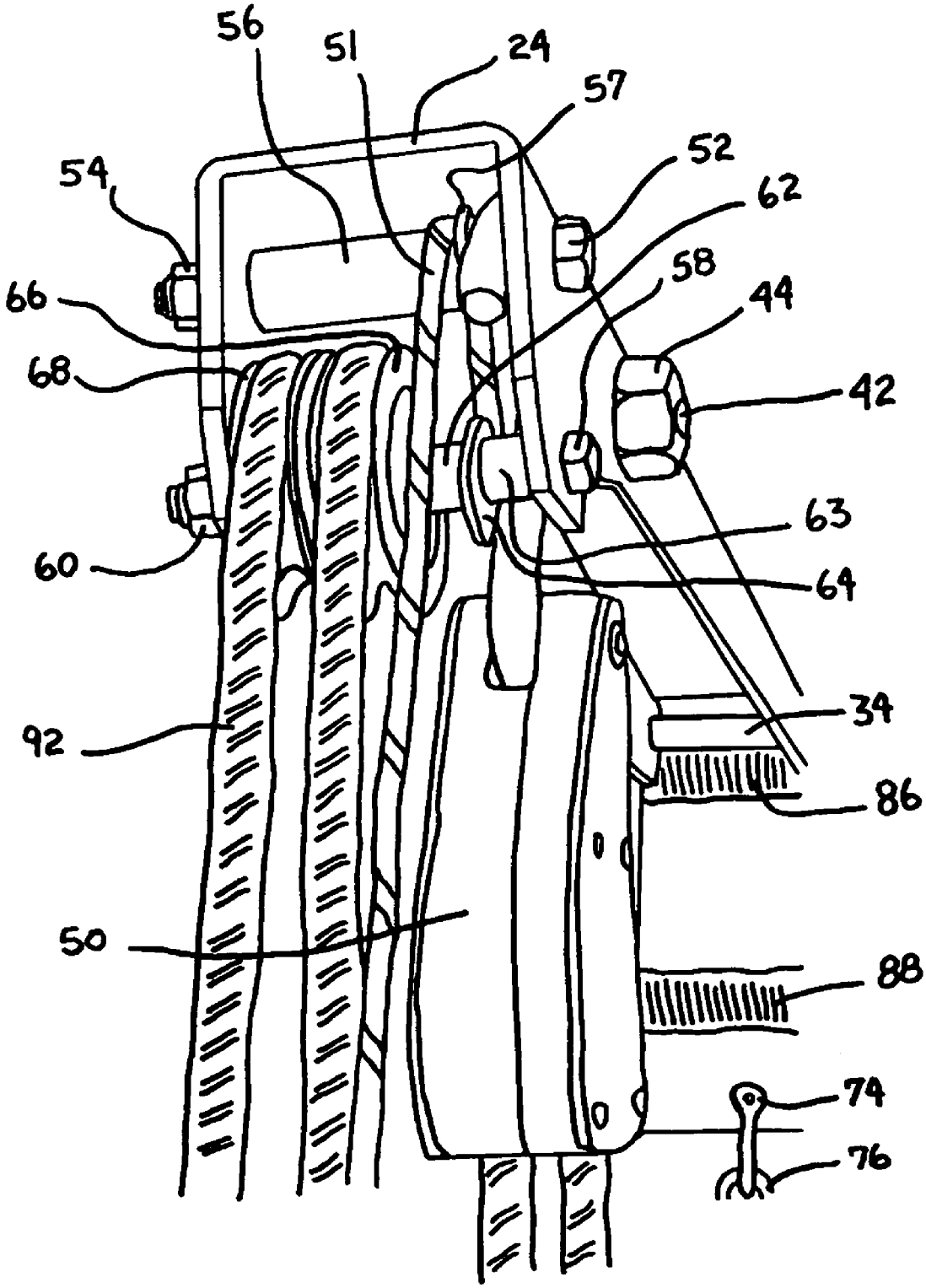
FIG. 3 is a front view in detail of the portion indicated by the section lines 3-3 in FIG. 1.

As seen in FIG. 1 and in FIG. 3, hoist rope 92 is initially connected to horizontal support 24 at rope tie hole 72. The hoist rope 92 first travels downwards to an outside pulley, one of three pulleys in triple snatch block 70. Hoist rope 92 then travels upwards to outer idler pulley 68 and back down to the central pulley in the triple snatch block 70. Hoist rope 92 then travels upwards to inner idler pulley 66 and back down to the other outer pulley on the triple snatch block 70. Lastly, the hoist rope 92 travels upwards to locking pulley 50 and back downward to the ground. When the loose end of hoist rope 92 is pulled towards the ground, the snatch block 70 is forced upwards towards the locking pulley 50. This is evident because the pulleys inside the snatch block 70 are the only pulleys that are not in a fixed position and are therefore forced upwards when the amount of hoist rope 92 between the two sets of pulleys is reduced. As viewed from the left side per FIG. 1, when the end of hoist rope 92 is pulled towards the ground, locking pulley 50 has a counterclockwise rotation as do the other five non-locking pulleys. While the non-locking pulleys will freely rotate clockwise or counterclockwise, locking pulley 50 will only rotate clockwise by activating locking pulley release 49 via the locking pulley release line 51. Therefore, pulling the loose end of hoist rope 92 towards the ground will cause locking pulley 50 to rotate counterclockwise and will also force snatch block 70 to move closer to locking pulley 50. If hoist rope 92 is released at anytime during hoisting, locking pulley 50 will restrain from clockwise rotation and will automatically lock the hoisted load in place. This is very beneficial because it is difficult to keep continued pressure on hoist rope 92 during hoisting. It is also a safety feature in case hands slip from hoist rope 92, and it allows for hoisted loads to be locked in place without the need for tying the loose end of hoist rope 92 to an adjacent tree.

To lower hoisted objects, simply pull slightly on hoist rope 92 enough to take the weight off of locking pulley 50. Holding tightly to hoist rope 92 in preparation to accept the weight of the lowered object, pull downward on locking pulley release line 51 which will activate locking pulley release 49. This allows clockwise rotation of all 6 pulleys, including locking pulley 50. Feeding hoist rope 92 upwards through locking pulley 50 will increase the amount of rope between the two sets of pulleys causing the snatch block 70 to descend towards the ground. As stated before, this is evident because the pulleys in the snatch block are the only pulleys that are not in a fixed position. Again, locking pulley release 49 must be activated to lower hoisted objects. If locking pulley release line 51 is set loose at anytime, the locking pulley release 49 will return to the locked position. Therefore, a single person can perform the lowering operation by using the left hand to control the locking pulley release line and the right hand to control the hoist rope 92. Again, start by pulling on hoist rope 92 to accept the full weight of the hoisted load with the right hand. Next, pull downward on pulley release line 51 to allow clockwise rotation of all six pulleys and maintain downward pressure on pulley release line 51 until you need to relock the load in place. Feed hoist rope 92 upward through locking pulley 50 until you can not reach any higher. At this point, set loose of the locking pulley release line 51 to relock the load. By locking the load, the right hand can be repositioned to repeat the above mentioned process until the load is grounded.

Figure 6:
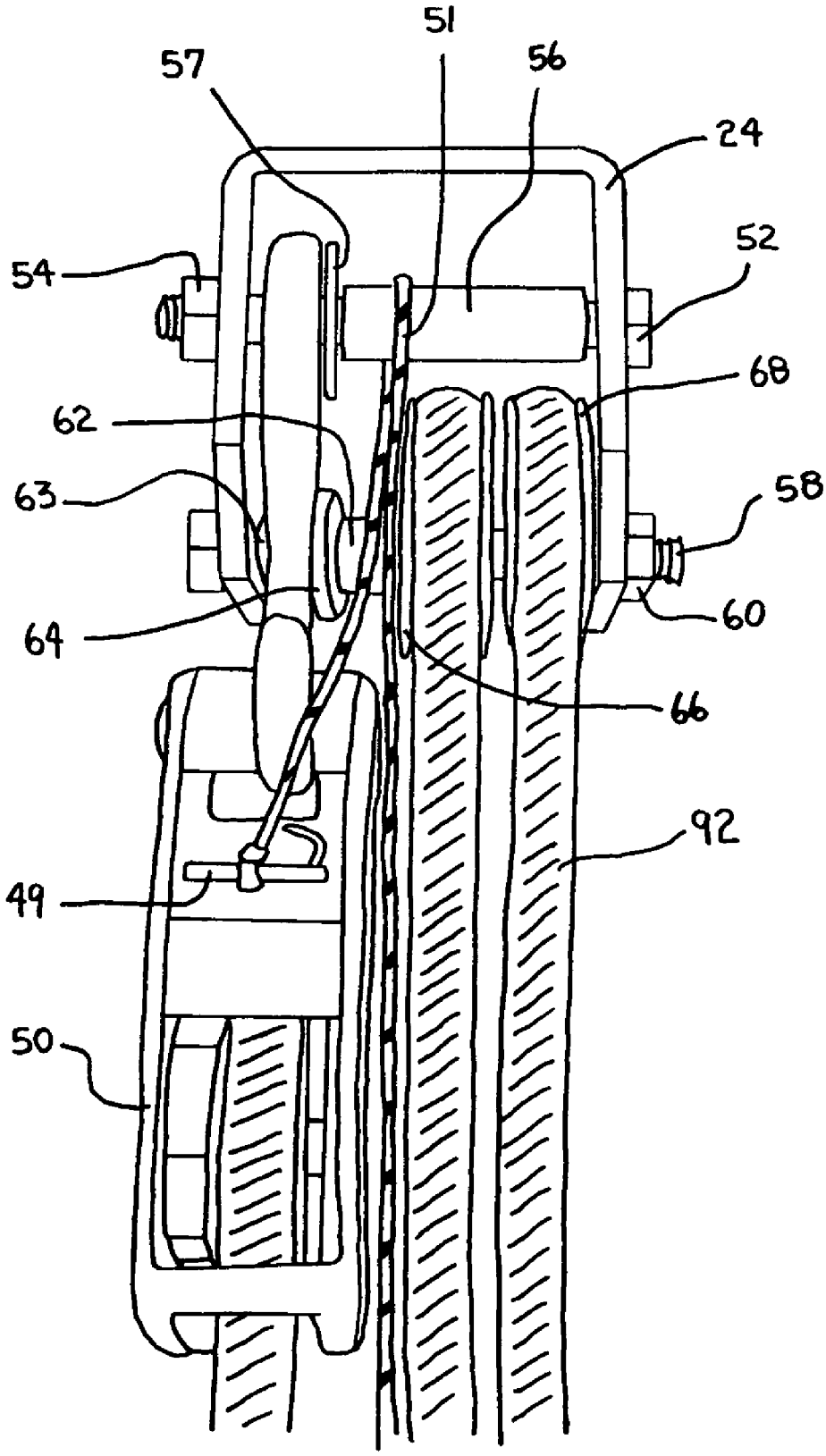
FIG. 6 is a view in detail showing a ramification in the positioning of the upper pulleys.

Portable game hoist 10 utilizes six pulleys in a block and tackle arrangement. Each pulley carries an equal amount of the total weight. For example, if holding a weight of 240 pounds, each pulley will have a weight of 40 pounds exerted upon itself. This also means that the amount of pull force required at the loose end of hoist rope 92 to begin counterclockwise rotation (as viewed from the left side of the preferred embodiment) of the six pulleys will also be roughly 40 pounds (roughly because the friction between the pulleys and their support bolts will slightly increase the pull force required). When in locked position and holding a weighted object, the position of the locking pulley 50 in relation to the other five pulleys is important. If the locking pulley 50 was located as seen in FIG. 6 (not the preferred arrangement), the locking pulley 50 would be the second pulley from the hoisted item; and therefore, would hold half of the load, or 120 pounds, when in a locked position because the locking pulley 50 would terminate the transfer of weight through the hoist rope 92 to the other four pulleys. Referring to the preferred pulley arrangement as seen in FIG. 3, the weight from the hoisted object is transferred through hoist rope 92 and through the five non-locking pulleys prior to passing through the locking pulley 50. In this arrangement, the locking pulley 50 in a locked position must hold only 40 lbs. or one sixth of the total locked weight. Again, FIG. 6 demonstrates another possible pulley arrangement for portable game hoist 10, but not the presently preferred pulley arrangement.

As seen in FIG. 3, locking pulley support bolt 52 is located directly above central idler pulley 66 and outer idler pulley 68. Locking pulley support bolt bushing 56 freely rotates on locking pulley support bolt 52 and is positioned to keep hoist rope 92 from jumping out of the pulleys below. Locking pulley support bolt bushing 56 also aids the pull and release of locking pulley release line 51 and protects against abrasion. Locking pulley support bolt bushing 56 terminates at locking pulley support bolt washer 57. Locking pulley support bolt washer 57 restrains locking pulley 50 from horizontal movement and also separates locking pulley support bolt bushing 56 and locking pulley 50. Locking pulley 50 is supported directly onto locking pulley support bolt 52, allowing locking pulley 50 to be hung as high as possible inside horizontal support 24.

Continuing in FIG. 3, Idler pulley support bolt 58 is positioned directly beneath locking pulley support bolt 52 and provides support to outer idler pulley 68 and inner idler pulley 66. Inner idler pulley 66 and outer idler pulley 68 are restricted from moving horizontally by idler pulley support bolt bushing 62, idler pulley support bolt washer 64 and idler pulley support bolt spacer 63. Idler pulley support bolt washer 64 is restricted from horizontal movement by idler pulley support bolt bushing 62 and idler pulley support bolt spacer 63; and therefore, restricts horizontal movement of locking pulley 50.

As seen in FIG. 1, Diagonal support 26 allows weight transfer of hoisted objects from the outer end of horizontal support 24 to the supporting tree or columnar member. Diagonal support eyebolt 80 provides attachment means for hang assist strap 90 and lower chain shackle 78. Upper chain shackle 74 and lower chain shackle 78 are attached to the ends of vertical chain support 76. Vertical chain support 76, along with upper chain shackle 74 and lower chain shackle 78, provides low weight flexible attachment of vertical support 20 to diagonal support eyebolt 80 below. This low weight and flexible connection of vertical support 20 to diagonal support 26 contributes to the overall goal of providing a lightweight and collapsible hoisting device. Also, the length of vertical chain support 76 can be made smaller or larger by varying the number of chain links between upper chain shackle 76 and lower chain shackle 78. Adjusting the length of vertical chain support 76 will change the angle between horizontal support 24 and diagonal support 26. Consequently, horizontal support 24 can be leveled even when hung to a tree that is slightly out of plumb. Snatch block 70 includes a hook for attachment to a gambrel when processing deer or for attaching directly to a automatic barrel type feeder. Most commercially available barrel feeders include a support bar above the barrel which can be attached to the hook on the snatch block 70. Furthermore, a screw in step or a climbing stick, commonly used with fixed tree stands, may be required to hang portable game hoist 10 at the height sufficient to completely raise a game animal off the ground or to raise a feeder barrel out of the reach of feeding game animals. Note that this is only a requirement for hanging portable game hoist 10 and not for operation of portable game hoist 10.

CONCLUSION, RAMIFICATIONS, AND SCOPE

Accordingly the reader will see that according to the invention, I have provided the only hoisting device that offers a block and tackle rope and pulley arrangement mounted directly to a collapsible and portable weight supporting frame where one of the pulleys in the block and tackle arrangement is a locking pulley with a release mechanism which can be operated out of arms reach by an attached rope. For an additional novel feature, consider the following: The combination of vertical support 20 and vertical chain support 76 as seen in FIG. 1 is not found in prior art inventions. If the proximal end of horizontal support 24 were connected to the lower end of diagonal support 26 by a solid metal component eliminating vertical chain support 76, the added weight and bulk would make it less portable. If vertical chain support 76 were eliminated leaving vertical support 20 unchanged, the diagonal support would be allowed to slide down the tree if hang assist strap 90 loosens or fails for any reason. If the vertical support 20 were eliminated and the flexible connection traveled from the horizontal support 20 to diagonal support 26, the units lateral support would be compromised and other attachment means to a tree or columnar structure would need to be determined. These examples are only to help explain the benefits of this novel feature.

While the above description contains many specificities, these should not be construed as limitations on the scope of the invention, but as exemplifications of the presently preferred embodiments thereof. Many other ramifications and variations are possible within the teachings of the invention. For example, the flexible means provided by upper chain shackle 74, vertical chain support 76 and lower chain shackle 78 could be substituted for a single steel cable utilizing compression sleeves to form a loop at each end. Furthermore, other locking pulley devices with a release mechanism could be used in place of the Rope Ratchet locking pulley as described in my preferred embodiment. The use of the Rope Ratchet locking pulley is the currently preferred locking pulley for my invention. For another example variation, horizontal support 24 as well as the other frame components could be manufactured from high strength composite material to further reduce the weight and increase the portability of the device. Thus, the scope of the invention should be determined by the appended claims and their legal equivalents, and not by the examples given.

I claim:

1. A portable and collapsible hoisting apparatus, comprising;

(a) a horizontal support having a proximal and a distal end (b) a diagonal support having an upper end and a lower end wherein the upper end is pivotally attached below and towards the distal end of said horizontal support (c) a vertical support having an upper end and a lower end wherein the upper end is pivotally attached to the proximal end of said horizontal support having means for flexible attachment to the lower end of said diagonal support (d) a plurality of pulleys including a locking pulley attached to the distal end of said horizontal support with means of connection to a snatch block below to create a block and tackle arrangement whereby an object can be hoisted and automatically locked in place.

2. The hoisting apparatus of claim 1 further including a plurality of straps having means for attachment to the upper end and lower end of said vertical support to help secure the hoisting apparatus to a tree or columnar member.

3. The hoisting apparatus of claim 1 further including a hang assist strap having means for attachment to the lower end of said diagonal support to help secure hoisting apparatus to a tree or columnar member.

4. The hoisting apparatus of claim 3 wherein means for attachment of said hang assist strap to the lower end of said diagonal support is a diagonal support eyebolt.

5. The hoisting apparatus of claim 3 wherein said hang assist strap supports a hang assist strap hook.

6. The hoisting apparatus of claim 1 further including a hang assist bolt attached to the upper end of said vertical support.

7. The hoisting apparatus of claim 1 wherein said means for flexible attachment of said vertical support to said diagonal support consist of a vertical chain support, an upper chain shackle, a lower chain shackle, and a diagonal support eyebolt.

8. A portable and collapsible hoisting apparatus, comprising;

(a) a horizontal support having a proximal and a distal end (b) a diagonal support having an upper end and a lower end wherein the upper end is pivotally attached below and towards the distal end of said horizontal support (c) a vertical support having an upper end and a lower end wherein the upper end is pivotally attached to the proximal end of said horizontal support having means for flexible attachment to the lower end of said diagonal support (d) a plurality of pulleys attached to the distal end of said horizontal support with means of connection to a snatch block below to create a block and tackle arrangement thereby decreasing the amount of force required to lift weighted objects.

9. The hoisting apparatus of claim 8 further including a plurality of straps having means for attachment to the upper end and lower end of said vertical support to help secure the hoisting apparatus to a tree or columnar member.

10. The hoisting apparatus of claim 8 further including a hang assist strap having means for attachment to the lower end of said diagonal support to help secure hoisting apparatus to a tree or columnar member.

11. The hoisting apparatus of claim 10 wherein means for attachment of said hang assist strap to the lower end of said diagonal support is a diagonal support eyebolt.

12. The hoisting apparatus of claim 10 wherein said hang assist strap also supports a hang assist strap hook.

13. The hoisting apparatus of claim 8 further including a hang assist bolt attached to the upper end of said vertical support.

14. The hoisting apparatus of claim 8 wherein said means for flexible attachment of said vertical support to said diagonal support consist of a vertical chain support, an upper chain shackle, a lower chain shackle, and a diagonal support eyebolt.

15. A portable and collapsible hoisting apparatus, comprising;

(a) a horizontal support having a proximal and a distal end (b) a diagonal support having an upper end and a lower end wherein the upper end is pivotally attached below and towards the distal end of said horizontal support (c) a vertical support having an upper end and a lower end wherein the upper end is pivotally attached to the proximal end of said horizontal support having means for attachment to the lower end of said diagonal support (d) a plurality of pulleys including a locking pulley attached to the distal end of said horizontal support with means of connection to a snatch block below to create a block and tackle arrangement whereby an object can be hoisted and automatically locked in place.

* * * * *